United States Patent [19]

Wyatt et al.

[11] Patent Number: 4,704,804

[45] Date of Patent: Nov. 10, 1987

[54] METHOD OF AND APPARATUS FOR TEMPERATURE CONDITIONING OF MATTER

[75] Inventors: William G. Wyatt, Arlington; Jack C. Page, Dallas, both of Tex.

[73] Assignee: VE Holding Corp., Arlington, Tex.

[21] Appl. No.: 589,260

[22] Filed: Mar. 13, 1984

[51] Int. Cl.[4] ..... F26B 5/04; F26B 3/00; F26B 21/06; F26B 19/00

[52] U.S. Cl. ..... 34/15; 34/17; 34/26; 34/31; 34/33; 34/46; 34/210; 34/217

[58] Field of Search ..... 34/15, 17, 26, 31, 33, 34/46, 34, 210, 212, 217

[56] References Cited

U.S. PATENT DOCUMENTS

| | | | |
|---|---|---|---|
| 1,035,362 | 8/1912 | Bauer | 34/217 |
| 1,174,721 | 3/1916 | Henson | 426/463 |
| 1,750,839 | 3/1930 | Furbush | 34/212 |
| 3,058,235 | 10/1962 | Morris et al. | 34/164 |
| 4,288,978 | 9/1981 | Wyatt | 431/281 |
| 4,291,472 | 9/1981 | Lewis | 34/34 |

*Primary Examiner*—John J. Camby

*Attorney, Agent, or Firm*—Stanley R. Moore; Thomas L. Cantrell

[57] ABSTRACT

Method of and apparatus for temperature conditioning of matter of the type wherein matter to be conditioned is exposed to a vapor within a vessel for select heating and/or moisture absorption or desiccation. The system includes selectively providing a mixture of condensible and noncondensible gases while controlling the enthalpy, partial pressure and dew point thereof. The gas mixture is delivered to a vessel and interacted with matter disposed therein. The temperature of the matter is brought to the approximate dew point of the condensible and noncondensible gas mixture. In this manner, both the ultimate temperature and moisture content of the matter to be conditioned may be controlled by selectively controlling the aforesaid parameters of enthalpy, partial pressure and dew point. Control of the aforesaid parameters may likewise be affected by controlling the vessel pressure and the rate at which energy is supplied to the condensible and noncondensible gas mixture.

82 Claims, 6 Drawing Figures

METHOD OF AND APPARATUS FOR TEMPERATURE CONDITIONING OF MATTER

BACKGROUND OF THE INVENTION

1. Field of the Invention

The present invention relates to temperature conditioning systems and, more particularly, to a temperature conditioning system for select heating and liquid constituent control of liquids and/or solids through the control of enthalpy, partial pressures and dew point within a heating medium comprising a mixture of condensible and non-condensible gases.

2. History of the Prior Art

The prior art is replete with heating systems for both solids and liquids. Many of these systems incorporate direct contact heat exchange wherein the temperature of the heating medium is the single-most critical operational parameter. The contact is generally made between the substance to be heated and the products of combustion from a furnace or the like.

U.S. Pat. No. 4,275,708 to Wood teaches a method and apparatus for direct contact water heating utilizing the direct heat of combustion for developing hot water. A vessel is set forth therein containing a plurality of heat absorbing bodies which act in combination as a heat exchanger and also as an oxygen stripping chamber. The lower compartment within the vessel comprises a combustion chamber and reservoir for storage of the hot water heated in the furnace.

While the aforesaid prior art systems are effective in overcoming many of the disadvantages of prior art direct contact combustion heating systems, numerous inherent problems remain. Serious concerns in direct contact combustion furnace heating systems include high contact temperature, corrosion, heat distribution, oxidation, and incompatibility with certain substances to be heated. The results of combustion of a conventional furnace include (a) intense heat of both radiant and convective varieties, (b) non-combustibles, and (c) the products of combustion including carbon dioxide and water. When the substance to be heated is sensitive to either intense heat and/or the products of combustion in the presence of intense heat, the aforesaid furnace configurations are not useful. In such circumstances heating systems incorporating boiler networks have been implemented. In these systems, the heat of combustion is first transferred to a vessel containing water which is converted into steam and used as the heating medium.

The prior art of boiler heating systems extends into technological antiquity. Steam from boiler systems has been utilized for comfort heating as well as commercial heat application for many decades. Other applications of conventional steam boilers include the treatment of solids such as tobacco leaves, grain, flour and animal feed. For example pelletized animal feed is often treated with steam to improve the pelletizing operation and digestibility of the feed by the animal. The steam which heats the feed is generally injected into the feed prior to pelletizing to condition it. The feed coming to the pelletizer often has between eleven and twelve percent moisture and is at ambient temperature. The steam system conditioning equipment raises the temperature of the feed as close as possible to approximately 200° to improve the digestibility by the animal. It is necessary, however, to assure that none of the feed gets so hot as to scorch the feed or break down the vitamin additives Unfortunately, with live steam, the maximum temperature rise that can be produced by a boiler system without adding so much water that the pelletizing is no longer feasible is approximately 120° F. Thus, with an adequate boiler, 200° F. feed can be obtained only when the incoming feed is at or above 80° F. At other times, and particularly in the winter, feed temperature of about 160° F. to 180° F. is the maximum attainable.

Other prior art grain treatment systems have addressed the need for moisture control with apparatus which introduces steam and air in combination. For example, U.S. Pat. No. 1,185,622 to Boss teaches a 1916 process of conditioning food forming substances. The Boss patent sets forth the moisture treatment of grain or the like in such a manner that it is hydroscopically conditioned by either adding or taking moisture from such particulate matter. These systems are useful in preparing the grain to a condition where it is uniformly hydrous in its character. Such product is more thoroughly digested in given quantities, in shorter time and with greater nutritive and body building effect. It has thus been a goal in the prior art grain condition technology to provide a treating "fluid" capable of delivering or withdrawing moisture or other substance to or from the material to be acted upon for swelling or shrinking or wetting or drying the material as needed. To affect this end result, air and steam have been utilized in various heating and flowing configurations such as that initially shown in the Boss patent. This prior art does not envision heating the grain to a controlled higher temperature so as to cook it for better digestibility.

More advanced prior art grain treatment technology has generally included refinements on the age old principle of steam moisturizing. For example, U.S. Pat. No. 1,574,210 to Spaulding teaches a method and apparatus for steaming grain and the like. The Spaulding system utilizes gravity descent and angularly disposed baffles for deflecting the grain. Steam supply ports are provided for the steaming operation of the grain during its descent. A prior U.S. patent issued to Henson under U.S. Pat. No. 1,174,721 sets forth an improved method of supplying moisture to grain and the like by utilizing the flow of steam and air heated by said steam prior to entry into a treatment chamber. Moisture is added to the particulate matter such as grain by introducing steam with the air prior to entry into the treatment chamber. The Henson patent further teaches the use of a hygrometer to determine the moisture content of the air. Grain which is fed into the interior of the mixing treatment chamber comes in contact with the vapor which tends to condense thereupon. In this manner, the amount of moisture deposited in the substance passing through the treatment chamber may be calculated from the data given. Such a system will also work with raw steam being used instead of the mixture of steam and air.

These prior art grain treatment systems have been shown to be effective in removing or adding moisture to grain. Unfortunately, the degree of moisture contributed to the particulate matter is generally hard to control and/or define in any empirical manner short of raw data measurements such as that discussed above. Moreover, these prior art systems do not envision control of heat added to the grain.

Some conventional technology has addressed the issue of control of various aspects of steam itself including both the adding of moisture to and removal of moisture from particulate matter. For example, U.S. Pat. No.

4,024,288 issued to Witte illustrates a method of treating particulate matter for conditioning oil containing vegetable raw materials. In the Witte patent, air and steam are again utilized for the treatment of the raw material. The utilization of super-heated steam coming from a heat exchanger which is then mixed with air is set forth and shown in the Witte reference and discloses an effective means for immersing the raw material into a steam and hot air bath. Material leaving the bath is then dried by air issuing from a hot air heat exchanger. While effective in heating by means of steam, Witte maintains little control over the temperture to which the raw material is heated and requires two separate fluid stream to attain the desired temperature and moisture levels.

U.S. Pat. No. 4,249,909 issued to Comolli sets forth a staged process for drying wet carbonaceous material. The stage drying procedure permits wicking up of hydrocarbons contained in coal to seal the surface of dried coal products sufficient to prevent appreciable reabsorption of moisture and consequent heating and spontaneous ignition. The Comolli procedure was developed for this particular application and in so doing manifested the advances made in the state of the art in steam treatment systems. These advances may be seen in part in the efforts to define and control various parameters of steam such as partial pressures. The pressures exerted by each constituent alone in the volume of a mixture at the temperature of the mixture are called partial pressures. The partial pressure is directly related to the mole fraction of a constituent present in a mixture and the total pressure thereof.

Control of partial pressure in a steam heating medium affords numerous benefits. For example, the heat treatment of coal as set forth in the Comolli patent illustrates the feasibility of controlling partial pressures in steam for purposes of controlling the rate of "drying" and prevention of the "pop corn" effect. Removal of surface moisture from the coal is therein accomplished rapidly with circulating moist air at atmospheric pressure and about 220° F. dry bulb temperature and 130° F., wet bulb temperature. In the second stage, steam is supplied to provide a more humid environment with the wet bulb temperature of the circulating air at about 160° F. so as to provide therein a lower water partial pressure differential relative to that of the coal. This more humid condition results in slower removal of additional moisture from the coal particles so that not only is particle rupture prevented, but also low volatility hydrocarbons and tars contained in the coal are wicked to the surface where they serve to substantially seal the pores.

It may thus be seen that the treatment of particulate matter with steam has evolved through the years through the utilization of steam as a drying medium. The advantages of steam as a moisturizing and heating medium for food stuffs such as grain and flour may likewise be useful if the end product can be selectively controlled. Conventional treatment processes for cellular matter such as grain generally use raw steam as a sole element of a heating medium or in combination with air or similar non-condensible gases for the moisturizing process. Such processes are typically incapable of effectively treating the cellular particulate matter in the precise manner necessary for maximum utilization. For example specific moisture levels, heat absorption and final grain temperatures must be obtained for reliable and effective conditioning. Reasons for the inability of conventional apparatus to meet such demands of the market are due to their inability to simultaneously control moisture content, heat absorption and final product temperature.

It would be an advantage, therefore, to provide a system for select temperature and moisture conditioning of either liquids or solids by controlling the enthalpy, partial pressures and dew point of the heating medium. The system of the present invention affords such an operation by utilizing a steam vapor generator, or the like in conjunction with a flow system for the heating of both liquid and/or solids passed therein. The rate of heat supplied, may therein be controlled by the rate of fuel burning while the moisture content and the maximum temperature generated in the product can be controlled through the partial pressure of the condensible vapor and dew point. The partial pressure and dew point are, in turn, determined by the fluid flow rates in the vapor generator and/or the introduction of extra amounts of non-condensible gas and the total pressure at which the system operates.

SUMMARY OF THE INVENTION

The present invention pertains to conditioning systems for select heating and liquid constituent control of liquids and/or solids through the control of enthalpy, partial pressures and dew point in a heating medium comprising a mixture of condensible and non-condensible gases. More particularly, one aspect of the invention comprises an improved method of heat conditioning of matter of the type wherein matter to be conditioned is exposed to a vapor within a vessel for select heat conditioning. The improvement comprises means for supplying a mixture of condensible and non-condensible gases at a select enthalpy, partial pressures and dew point to a housing. Means are provided for delivering matter to be conditioned and the heating gas mixture to the housing for the interaction therebetween.

A typical temperature enthalpy curve for water and non-condensible gas shows that as energy is taken out of the medium a major fraction of the enthalpy is transferred at a temperature close to the dew point. Thus it becomes relatively easy to control the temperature of the matter receiving the heat energy to a temperature approximating the dew point. The moisture condensed on the matter can then be controlled by the partial pressure of the vapor component of the input stream, and the temperature of the exhaust stream. The dew point of the mixture can be increased by increasing the partial pressure of the vapor or through increasing the total pressure at which the system operates. The dew point can be decreased by reducing the partial pressure of the vapor, or through the introduction of more non-condensible gas such as excess air, or through reducing the total pressure at which the system operates. This may be true even to the point of a partial vacuum. Obviously a condensible vapor other than water can be used to provide a different temperature, enthalpy and dew point.

In another aspect, the invention includes a system for counter-current flow heating and moisturizing of matter by controlling the enthalpy partial pressures and dew point of the treatment fluid. A housing is provided for containing the flow of the matter therethrough. Means are also provided for furnishing a mixture of condensible and non-condensible gases at select enthalpy, partial pressures and dew point. Means associated with the housing then direct the flow of the treatment fluid through the housing in a counter-current flow configuration relative to the matter passing therethrough.

In yet another aspect, the invention includes a multiple pass, direct contact, conditioning system wherein the heat treatment fluid is introduced into a second region for treatment and drying of the matter issuing from a first region. The treatment fluid is also collected from the treatment of the matter in the second region for introduction into the first region for treatment of the matter passing therethrough. This is one approximation of the counter-flow conditioner. In this manner, liquid is condensed on the matter in the first region and evaporated from the matter in the second region. The system may also include means for controlling the partial pressure and dew point of the heat treatment fluid comprising means for introducing non-condensible gases to the treatment fluid issuing from the second region prior to being introduced into the first region.

In a further aspect, the invention includes a method of heating matter flowing through a vessel to effect select temperature and moisture conditions therein. The method comprises the steps of providing a housing for passage of the matter therethrough and providing a mixture of condensible and non-condensible gases at select enthalpy, partial pressures and dew point for flow therein. Means are provided for introducing the gas mixture to a first end of the housing. Means are also provided for introducing the matter into a second end of the housing. In the embodiment, means are supplied for imparting counter-current flow to the matter and the mixture passing through the housing for the interaction therebetween. Two phases of interaction may be established between the mixture and the matter within the housing wherein the temperature and partial pressures of the first phase are substantially different from the temperature and partial pressures of the second phase. The temperature and partial pressures of the first phase are provided for moisture condensation on the matter moving therein. Likewise, the temperature and partial pressure of the fluid in the second phase are provided for select evaporation of moisture from the matter.

In yet a further aspect, the invention includes a method of and apparatus for producing matter having a select temperature comprising the steps of providing a vessel for the introduction of the matter therein and introducing both matter and a mixture of condensible and non-condensible gases having select enthalpy, partial pressures and dew point. The gas mixture is supplied to the vessel for engagement of the matter passing therein. Interaction regions are established between the matter and the gas mixture within the vessel. The gas mixture is then exhausted after engagement with the matter, and the matter collected after engagement with the gas mixture is produced at a select temperature.

BRIEF DESCRIPTION OF THE DRAWINGS

For a more complete understanding of the present invention and for further objects and advantages thereof, reference may now be had to the following description taken in conjunction with the accompanying drawings in which.

DETAILED DESCRIPTION OF THE PREFERRED EMBODIMENT

Figure 1:
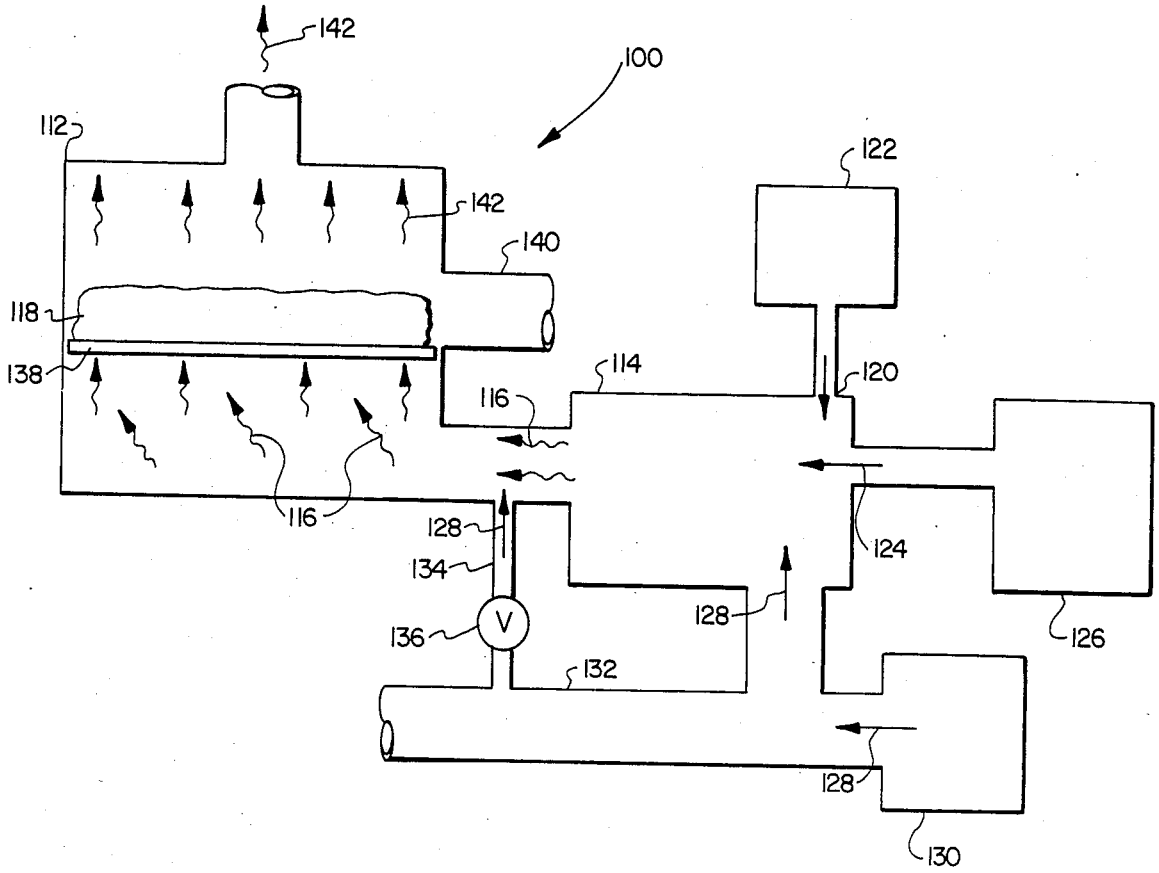
FIG. 1 is a diagramatical representation of a heating system constructed in accordance with the present invention.

Referring first to FIG. 1, there is shown a diagrammatical representation of one embodiment of a system 100 for thermal and liquid-constituent conditioning of matter in accordance with the principles of the present invention. The system 100 comprises a housing 112 coupled to a heat exchanger 114 adapted for heating fluid supplied thereto and discharging a heating medium 116 comprising a mixture of condensible and non-condensible gases. Matter 118 to be conditioned is disposed within housing 112 and exposed to the gas mixture 116 for thermal engagement therewith. Enthalpy and partial pressures and dew point of the mixture 116 are controlled to condition the matter 118 to select temperature and liquid constituent levels. In this manner both liquids and/or solids may be heated to a preselect condition without being subjected to excessive temperature extremes. The rate of actual heating may be controlled by the magnitude of heat generation in the heat exchanger, which may be of the vapor generator variety discussed below. In most instances, the liquid constituent is water and the actual moisture and temperature conditions generated within the matter 118 are controlled through the partial pressure of condensible vapor, which in turn is determined by the fluid flow rates and total pressure in the heat exchanger. Extra amounts of non-condensible gas may also be introduced to the gas mixture 116 to alter the dew point and vapor partial pressure.

Still referring to FIG. 1, the heat exchanger 114 may comprise a vapor generator of the type set forth and described in U.S. Pat. Nos. 4,211,071, 4,288,978 and 4,337,619 assigned to the assignee of the present invention. Other heat generation systems are, of course, also applicable. Fuel 120 is delivered to the heat exchanger 114 from a fuel supply 122. A fluid 124, such as water, to be heated into a condensible vapor, such as steam, is delivered to unit 114 from fluid supply 126. Non-condensible gas 128, such as air, is delivered to unit 114 from gas supply 130, such as a conventional blower or compressor. The gas 128 may also be carried by supply line 132 to a downstream feed line 134 where a valve 136 may be used to control the proportionality of condensible and non-condensible gases in mixture 116 and thus the partial pressure thereof. Infusion of extra gas 128 through line 134 will reduce the concentration of condensible vapor therein and consequently the mole percentage of water present in mixture 116 which determines the dew point and partial pressure.

Within the housing 112, the matter 118 interfaces with the gas mixture 116 and is preferably supported by interface means 138. Access port 140 is provided for deposit and removal of the matter 118. As discussed below, the access port 140 may comprise automated conveyors and mass handling systems. Likewise interface means 138 may comprise a vibrating plate for particulate matter and/or paul rings for liquid disbursement. The gas mixture 116 engaging the matter 118 and passing through interface means 138 thus interacts with said matter to deliver heat and moisture thereto. With heat and moisture removed from gas mixture 116, post heating gas 142 egresses from housing 112 with a different temperature and moisture level. The resulting temperature and moisture condition of matter 118 is, however, related primarily to the dew point of the of gas mixture 116 provided adequate heat and moisture are supplied.

Figure 2:
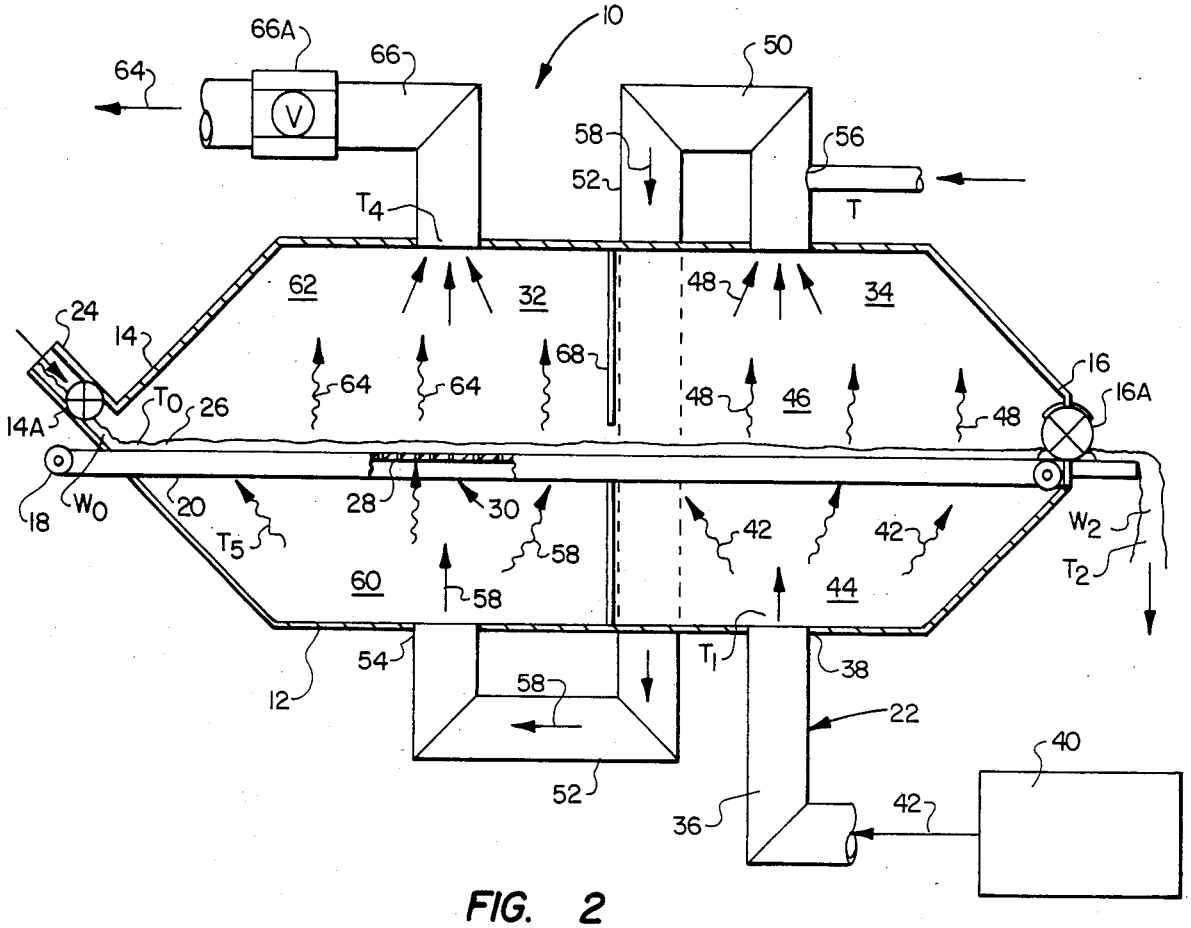
FIG. 2 is a side-elevational cross-sectional view of a diagramatic representation of one embodiment of a counter-current type heating system constructed in accordance with the principles of the present invention.

Referring now to FIG. 2, there is shown, one embodiment of a specific counter-current type heating system constructed in accordance with the principles of the present invention. The counter-current system 10 comprises a vessel 12 having a first end 14 constructed for entry of the matter to be heated and a second end 16 constructed for egress of said heated matter. Rotary presssure locks 14A and 16A, or the like may be utilized across ends 14 and 16, respectively, for facilitating control of the pressure within vessel 12. The vessel 12 further includes conveying means 18 shown herein as a vibrating plate or belt 20 for conveying ingressing matter from end 14 to end 16. A heat duct network 22 is coupled to the vessel 12 in multiple passage, flow communication therewith for the distribution of a select treatment fluid at a select pressure therethrough and the treatment of matter distributed upon conveyor 20. In this manner, treatment fluid can be provided in accordance with the principles of the present invention to flow through the matter to be treated to impose select temperature and moisture level conditions thereon.

Still referring to FIG. 2, it is to be understood that the counter-current flow configuration depicted in vessel 12 is presented for purposes of illustration only. The present invention is adapted for heat or heat and moisture conditioning of liquids and/or solids. A counter-current flow pattern is but one approach. An integral element of the invention is, as stated herein, the control of enthalpy, partial pressures and dew point in the conditioning medium, which comprises a mixture of condensible and non-condensible gases. As stated above, partial pressures and dew point are directly related to the mole fraction of constituent present in a mixture and the total pressure thereof. In the present invention, the constituent of concern is the condensible gas and the partial pressure thereof has a direct bearing on the resulting absorption or desiccation associated therewith and the resulting temperature of the matter conditioned. The particular containment and mass handling system of FIG. 2 provides but one means for utilizing these partial pressures.

Referring still to FIG. 2, the vessel 12 thus constructed with an entry port 24 and pressure lock 14A through which matter such as grain 26, or the like, may be deposited. Conveyor belt 20 is likewise constructed with a plurality of apertures 28, as shown in cutaway section 30, for permitting the upward passage of treatment gases and vapor therethrough. The vessel 12 of this particular embodiment is divided into at least two compartments 32 and 34 for dividing the heat and moisture conditioning operation into at least two phases. The multiple phase configuration permits the heat and moisture level conditioning fluid to effect "moisture in" and "moisture out" conditioning upon the grain 26 passing through the vessel 12.

Addressing now the specific embodiment of the conditioning fluid network 22 of FIG. 2 a series of flow channels is provided for both introducing and collecting the fluid flow therethrough. A first channel 36 is coupled to a lower region 44 of the vessel 12 within second phase chamber 34. The fluid introduced through conduit 36 is diagramatically shown being received from a heat exchanger 40 which may be of the vapor generator variety set forth above. The fluid issuing from such a heat exchanger includes both condensible and non-condensible gases represented by flow arrows 42. The fluid 42 thus fills lower region 44 of the chamber 34 and passes upwardly through conveyor belt 20 into upper chamber 46. Once in upper chamber 46 the fluid 48 may contain a higher level of moisture in the form of vapor removed from the grain 26 through which it has passed. This second phase fluid is illustrated by arrows 48. The moisture laden fluid 48 is next collected from the upper chamber section 46 by venting conduit 50. The vent conduit 50 carries the fluid back to the underneath side of the chamber 12 by return conduit 52, wherein the fluid enters into, a lower region 60 of first phase chamber 32.

In accordance with the present invention, the fluid 48 entering conduit 50 may also be conditioned by a gas introduced at supply port 56 disposed in conduit 50. Port 56 may introduce, for example, dry air from a blower, or the like, to lower the partial pressure of the water vapor in and dew point of the fluid 48 egressing from chamber 34 and imparting a slightly higher velocity thereto. Such a step has been shown to keep grain dust or the like entrained within the mixture and is beneficial to the system. Moreover, such a step would cause the new fluid mixture identified by arrows 58 to have to be cooled slightly before more condensation would begin. In this manner, particulate matter in chamber 32 would be heated as well as absorbing moisture.

The fluid 58 issuing from conduit 52 is shown to enter a lower region 60 of chamber 32 and passes upwardly through perforated plate or belt 20. The conditioning fluid rising upwardly from the grain 26 of chamber 32 enters upper chamber region 62 in a cooled condition identified by arrows 64. The cooled vapor of arrow 64 then enters an exhaust conduit 66 for passage from the vessel 12. A partition 68 may be provided within the vessel 12 for effectively segregating the heat and moisture level conditioning fluid into two zones or chambers defined as 32 and 34. In this manner the fluid is permitted to both heat and modify the moisture level condition of the grain 26 in accordance with the principles of the present invention described.

By way of example, a system constructed in accordance with the vessel illustration of FIG. 2 and operated with a conventional feed grain 26 has been operated with the following results where:

$T_0$=temperature of incoming grain 24
$T_1$=temperature of the phase II fluid 42 (° F.)
$T_2$=temperature of the egressing grain (° F.)
$T_4$=temperature of the exhausting fluid 64 (° F.)
$T_5$=temperature of the phase I fluid 58 (° F.)
$W_0$=moisture content of the incoming grain 24
$W_2$=moisture content of the egressing grain
Flow=time for a set quantity of grain to pass through housing 12

The temperature $T_1$ of the gas mixture issuing into chamber 34 was on the order of 400–420° F. The incoming grain 24 had a temperature $T_0$ of 50° F. and a moisture content $W_0$ of 10.8% by weight. The gas mixture made two passes through the grain 26 conveyed through the vessel 12 and exhausted at a temperature $T_4$ on the order of 135° F. The temperature measurement $T_2$ of the grain 26 egressing from the vessel 12 was measured to be on the order of 220° F., which temperature appeared relatively constant irrespective of the mass flow rate. The moisture content $W_2$ was measured to be 12.3% by weight. The temperature $T_5$ of the gas mixture 58 issuing into chamber 14 of the vessel 12 was on the order of 210–215° F. The partial pressure of the gas mixture 58 was adjusted by introducing non-condensible gas in the form of air through port 56 subsequent to collection from chamber 16.

In the example described above, the gas mixture was allowed to engage the grain 26 upon the conveyor 20 in chamber 34 for dessication. The grain therein was previously moistened from phase I conditioning in chamber 32. The moisture contained within the grain particles themselves began to evaporate in the presence of the superheated mixture 42, and the temperature of the grain approaches the adiabatic saturation temperature of said gas mixture.

As stated above, the speed in which the grain 26 was conveyed through the vessel 12 did not noticably effect its final temperature. However, the grain being organic matter contains chemical bonds which are affected and responsive to heat and moisture conditions. The degree to which the chemical constituents are affected and/or "cooked" is a direct result of the temperature to which the grain 26 is raised in the aforesaid chambers. The actual temperature $T_2$ of the grain egressing from chamber 34 is primarily a function of the dew point of the gas mixture 42. It has been shown that grain adapted for poultry feed stock is advantageously conditioned by passage through such a system and manifests higher nutritive value and improved digestability.

Figure 4:
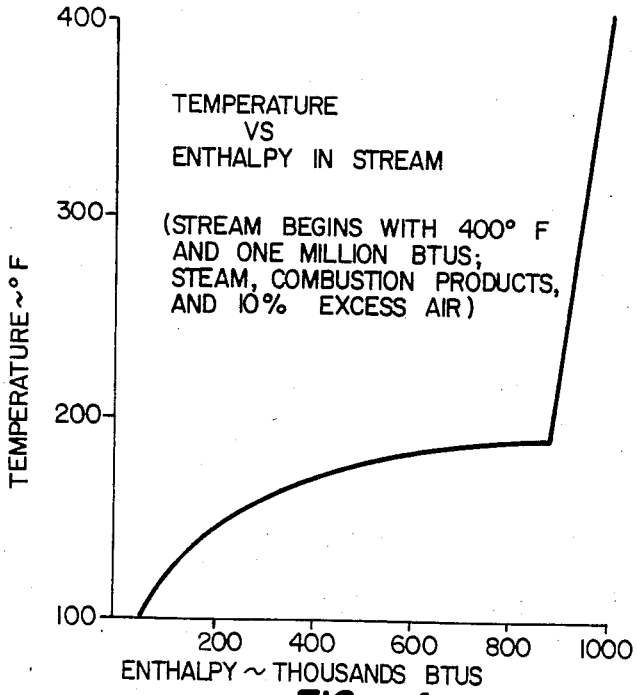
FIG. 4 is a graphical illustration of a temperature-enthalpy curve for water and non-condensible gas.

Referring now to FIG. 4 there is shown a temperature-enthalpy curve for water and non-condensible gas. Enthalpy in thousands of btu's is plotted across the abscissa of the chart. Temperature is plotted across the ordinate of the chart in degrees farenheit. The curve shows that as energy is taken out of the medium a major fraction of the enthalpy is transferred at a temperature close to the dew point. It thus becomes relatively easy to control the temperature of the matter receiving the heat energy to a temperature approximately the dew point.

As stated above, the moisture condensed on the matter being treated can be controlled by the partial pressure of the vapor component of the input stream and the temperature of the exhaust stream. The dew point of the mixture can be increased by increasing the partial pressure of the vapor through increasing the total pressure in the housing or vessel 12 as shown in FIG. 2. Likewise, the dew point can be decreased by reducing the partial pressures of the vapors through the introduction of more non-condensible gas such as excess air. Obviously a condensible vapor other than water can be used to provide a different temperature, enthalpy and dew point. Relative to control of dew point and partial pressure of the vapor through control of total housing pressure, it will of course be necessary to provide the appropriate conditioning vessel with appropriate pressure control apparatus.

Referring again to FIG. 2, the pressure within vessel 12 may be selected and raised or lowered for controlling the partial pressure and dew point of the treatment fluid. Appropriate pressure control apparatus must, of course, be incorporated across the multiple openings of the vessel 12. For example, entry port 24 and exit port 16 must include pressure locks 14A and 16A, respectively to permit a pressure higher or lower than atmospheric pressure within the vessel 12. Likewise, pressure control means 66A will be required at the point gas mixture 64 exhausts from the vessel 12. Pressure control apparatus 66A may comprise a simple valve assembly for pressurizing vessl 12 or a valve and pump unit for lowering the pressure therein. The provision of such pressure control apparatus are conventional in the art, will permit appropriate control of chamber pressure, vapor partial pressures and dew point in accordance with the principles of the present invention. It is likewise necessary for the pressure of the gas mixture 42 ingressing from input port 36 to be sufficiently high pressure to maintain said pressurized conditioning state or the pressure of the gas mixture 64 egressing from exhaust conduit 66 to be sufficiently low to maintain said pressure controlled conditioning state. In this manner the matter conditioning system of the present invention may operate with variations in total pressure utilized to implement select variations in partial pressures of the condensible vapor.

As discussed above, pressure variations may also be implemented in conjunction with or separate from conventional apparatus for selectively varying the burning rate of vapor generators or the like for change in enthalpy of the conditioning fluid. Where conditioning fluid generating apparatus is other than vapor generators, the rate of energy input to the conditioning fluid will also implement the requisite change in enthalpy for control of the system in accordance with the present invention. Such configurations of the present apparatus may also be seen to work in both the countercurrent and con-current flow configurations wherein the subject matter to be treated is exposed to the treatment fluid with the appropriate enthalpy, and partial pressures as set forth herein.

Figure 5:
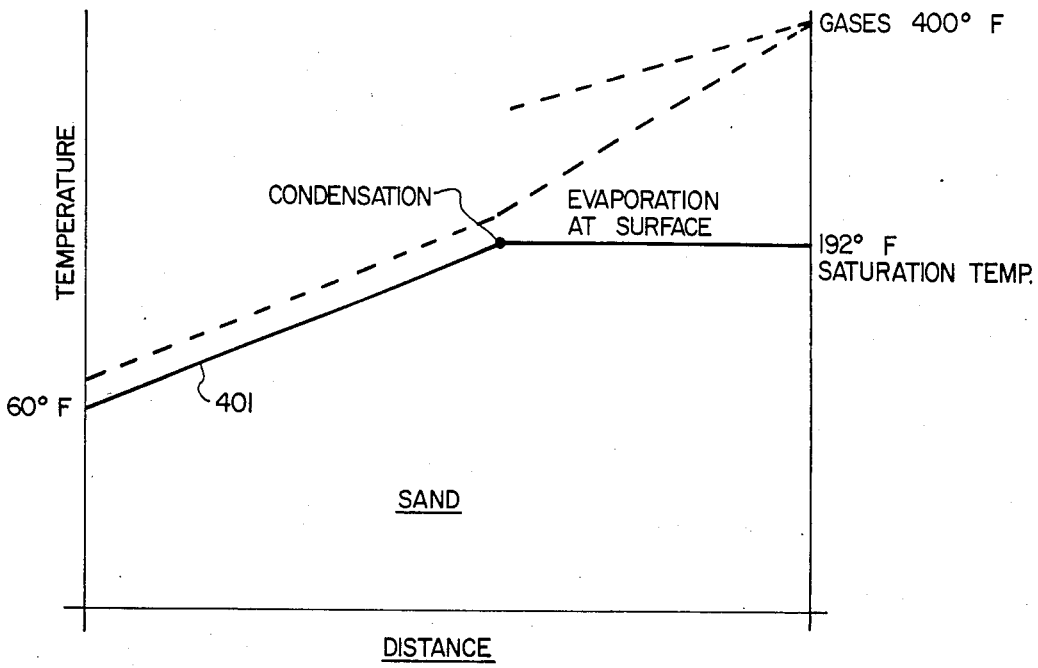
FIG. 5 is a representative conditioning curve of particulate matter such as sand when treated accordance with the principles of the present invention.
Figure 6:
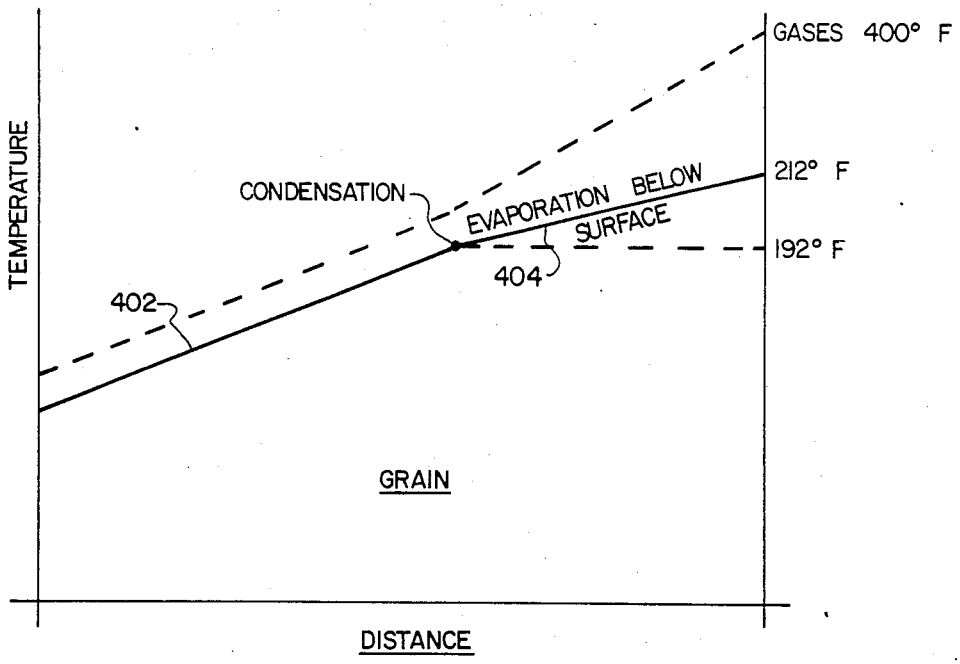
FIG. 6 is a representative heat and moisture curve obtained for grain treated in accordance with the principles of the present invention.

Referring now to FIGS. 5 and 6 there are shown conditioning curves for particulate matter. FIG. 5 represents the effect that the gas mixture 42 will have on non-porous matter such as sand. FIG. 6 represents the effect that the mixture 42 will have on a porous matter such as grain. The curves of FIGS. 5 and 6 show first slopes 401 and 402 reflecting the rapid heating of the matter with condensation. The grain will absorb some moisture which the sand will not. At the dew point the slopes 403 and 404 illustrate drastic differences. The sand will allow the moisture to evaporate and its temperature will remain stable for the period of evaporation. This is true even with a temperature of gas 42 at 400° F. The grain, having absorbed moisture, will exhibit evaporation below the surface and thus its temperature will rise above the saturation temperature with longer periods of exposure. This latter curve is reflected in the above data in accordance with the present invention.

Figure 3:
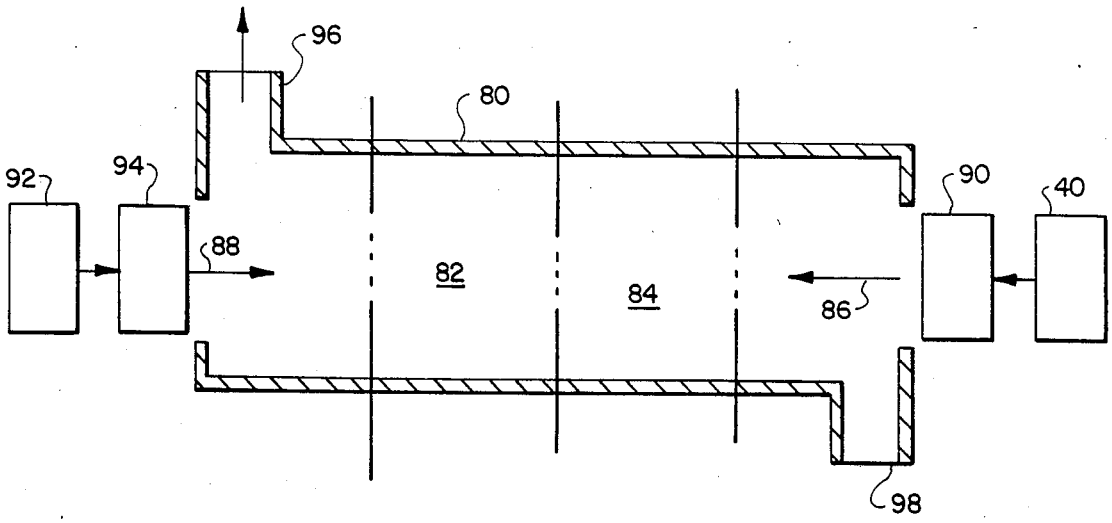
FIG. 3 is a schematic block flow diagram of the counter-current current flow system of FIG. 2.

Referring now to FIG. 3, there is shown a diagramatic illustration of the counter-current type heating system of FIG. 2. However, it should be noted that concurrent flow systems are also contemplated by the present invention; and likewise, the horizontal orientation of the drawing of FIG. 3 is for purposes of explanation only, and a vertical configuration is also to be deemed represented. By controlling the enthalpy, partial pressure and dew point of the vapor within the gas mixture, it is possible to selectively treat either solid or liquid matter with basic counter-current or concurrent flow to a select temperature.

Diagramatically, counter-current flow is illustrated in FIG. 3 by the presentation of at least two interaction zones 82 and 84 defined within a flow conduit, or passage 80. The zones 82 and 84 may be physically segregated by a baffle 68 or the like, as shown in FIG. 2. The zones may also simply be established dynamically by providing a sufficient length of passage 80 for at least two phases of interaction between treatment fluid 86 and the treated matter 88; the first phase 82 being moisture condensation and the second phase 84 being moisture desiccation.

Still referring to FIG. 3 treatment fluid 86 is shown issuing from a heat exchanger 40 comprising a vapor generator, or the like. The fluid passes into an air handling unit 90 wherein a select mixture of condensible and non-condensible gases are introduced into the passage 80. The matter to be conditioned is likewise delivered by a supply unit 92 and handling unit 94 disposed at an opposite end of passage 80. The handling unit 94 is constructed for imparting sufficient flow to the matter being conditioned for its movement through the passage 80 in a counter-current pattern to the treatment fluid flowing therein. The conveyor system of FIG. 2 is, for example, one embodiment of a handling system constructed in accordance with the principles of the present invention. Conventional auger, conveyor and/or gravity feed systems and the like may also be used. The passage 80 is thus shown to be adapted for the egress of conditioning fluid through port 96 and the egress of conditioned matter through the port 98. The conditioning zones 82 and 84 therebetween may be further defined as counter-current flow areas wherein the respective partial pressures are sufficiently different for altering the respective moisture level within the matter to be conditioned. Variations in both wet bulb and dry bulb temperatures may be monitored for assessing the conditioning occurring therein.

It is thus believed that the operation and construction of the present invention will be apparent from the foregoing description. While the method and apparatus shown and described has been characterized as being preferred, it will be obvious that various changes and modifications may be made therein without departing from the spirit and scope of the invention as defined in the following claims.

What is claimed is:

1. An improved system for temperature conditioning of matter of the type wherein matter to be conditioned is exposed to a vapor within a vessel for select conditioning wherein the improvement comprises means for supplying a mixture of condensible and non-condensible gases and controlling the enthalpy, partial pressure and dew point thereof;

said mixture comprising steam and non-condensible gases and said means for controlling said enthalpy includes means for varying the energy input of said condensible and non-condensible gases;

said mixture supply means comprising a vapor generator of the type wherein burning of fuel and oxidant is effected, said vapor generator including means for controlling the relative proportions of steam and non-condensibles issuing therefrom;

said means for controlling said enthalpy including means associated with said vapor generator for varying the burning rate thereof;

said means for controlling said partial pressure and dew point of said mixture including means for controlling the pressure within said vessel;

means for delivering said gas mixture; and means for interaction between said gas mixture and said matter thereby controlling the temperature of said matter of approximate the dew point of said mixture.

2. The system as set forth in claim 1 and further including means for controlling the partial pressures of said gas mixture and defining a first region of moisture absorption by said matter and a second region of moisture desiccation by said matter whereby the temperature and moisture content of said matter may be controlled.

3. The system as set forth in claim 2 wherein said gas mixture is introduced into said second region for moisture desiccation of said matter as it issues from said first region, said gas mixture further being collected from said second region for introduction into said first region for treatment of said matter therein, prior to its entry into said second region, whereby moisture may be absorbed by said matter in said first region and evaporated from said matter in said second region.

4. The system as set forth in claim 1 wherein said mixture comprises steam and non-condensible gases and said means for controlling said enthalpy includes means for varying the energy input to said condensible and non-condensible gases.

5. The system as set forth in claim 1 wherein said mixture comprises steam and non-condensible gases and said mixture supply means comprises a vapor generator of the type wherein burning of fuel and oxidant is effected, said vapor generator including means for controlling the relative proportions of steam and non-condensibles issuing therefrom.

6. The system as set forth in claim 5 wherein said vessel comprises a housing having means disposed therein for defining a first and a second region therein for exposing said matter in said first and second regions to said gas mixture at different partial pressures.

7. The system as set forth in claim 5 or 6 wherein said means for controlling said enthalpy includes means associated with said vapor generator for varying the burning rate thereof.

8. The system as set forth in claim 1 wherein said means for controlling said partial pressure and dew point of said mixture includes means for controlling the pressure within said vessel.

9. The system as set forth in claim 1 wherein said mixture of condensible and non-condendsible gases is supplied to said vessel at a temperature on the order of 400° F. and wherein said final temperature of said matter is on the order of 200° F.

10. The system as set forth in claim 9 wherein means are provided for defining a first region within said vessel for moisture absorption by said matter and a second region in said vessel for moisture desiccation from said matter and wherein said temperature of said gas mixture entering the said second region is on the order of 400° F. and said gas mixture issuing into said first region of said vessel is on the order of 200° F.

11. The system as set forth in claim 10 wherein said gas mixture issuing into said first region of said vessel comprises said gas mixture exhausted from said second region of said vessel.

12. The system as set forth in claim 3 wherein said means for controlling the partial pressure of said gas mixture issuing into said first region includes means for introducing non-condensible gases to said gas mixture exhausting from said second region prior to being introduced into said first region.

13. The system as set forth in claim 1 wherein said means for controlling the partial pressure of said gas mixture includes means for introducing non-condensible gases to said gas mixture prior to being introduced to said matter.

14. The system as set forth in claim 1 wherein said matter comprises organic material whose chemical composition is responsive to heat and moisture and wherein means are provided for selectively controlling the duration of exposure of said matter to said gas mixture and select partial pressures thereof within said vessel for select conditioning of said matter.

15. The system as set forth in claim 14 wherein said organic material comprises grain and said system is adapted for heat and moisture conditioning of said grain for improving the digestibility and nutritive value thereof.

16. The system as set forth in claim 1 and further including means for controlling the partial pressures of said gas mixture and defining a first region of moisture absorption by said matter and a second region of moisture desiccation by said matter whereby the temperature and moisture content of said matter may be controlled.

17. The system as set forth in claim 16 wherein said gas mixture is introduced into said second region for moisture desiccation of said matter as it issues from said first region, said gas mixture further being collected from said second region for introduction into said first region for treatment of said matter therein, prior to its entry into said second region, whereby moisture may be absorbed by said matter in said first region and evaporated from said matter in said second region.

18. The system as set forth in claim 1 wherein said mixture comprises steam and noncondensible gases and said means for controlling said enthalpy includes means for varying the energy input to said steam and non-condensible gases.

19. The system as set forth in claim 1 wherein said mixture comprises steam and non-condensible gases and said mixture supply means comprises a vapor generator of the type wherein burning of fuel and oxidant is effected, said vapor generator including means for controlling the relative proportions of steam and non-condensibles issuing therefrom.

20. The system as set forth in claim 19 wherein said vessel comprises a housing having means disposed therein for defining a first and a second region therein for exposing said matter in said first and second regions to said gas mixture at different partial pressures.

21. The system as set forth in claim 19 or 20 wherein said means for controlling said enthalpy includes means associated with said vapor generator for varying the burning rate thereof.

22. The system as set forth in claim 1 wherein said means for controlling said partial pressure and dew point of said mixture includes means for controlling the pressure within said vessel to control the partial pressure of said mixture contained therein.

23. The system as set forth in claim 1 wherein said mixture of condensible and non-condendsible gases is supplied to said vessel at a temperature on the order of 400° F. and wherein said final temperature of said matter is on the order of 200° F.

24. The system as set forth in claim 23 wherein means are provided for defining a first region within said vessel for moisture absorption by said matter and a second region in said vessel for moisture desiccation from said matter and wherein said temperature of said gas mixture entering the said second region is on the order of 400° F. and said gas mixture issuing into said first region of said vessel is on the order of 200° F.

25. The system as set forth in claim 24 wherein said gas mixture issuing into said first region of said vessel comprises said gas mixture exhausted from said second region of said vessel.

26. The system as set forth in claim 25 wherein said means for controlling the partial pressure of said gas mixture issuing into said first region includes means for introducing non-condensible gases to said gas mixture exhausting from said second region prior to being introduced into said first region.

27. The system as set forth in claim 1 wherein said means for controlling the partial pressure of said gas mixture includes means for introducing non-condensible gases to said gas mixture prior to being introduced to said matter.

28. The system as set forth in claim 1 wherein said matter comprises organic material whose chemical composition is responsive to heat and moisture and wherein means are provided for selectively controlling the duration of exposure of said matter to said gas mixture and select partial pressures thereof within said vessel for select conditioning of said matter.

29. The system as set forth in claim 28 wherein said organic material comprises grain and said system is adapted for heat and moisture conditioning of said grain for improving the digestibility and nutritive value thereof.

30. A system for heating and moisturizing particulate matter comprising:

a vessel for containing the flow of said matter therethrough;

means for imparting movement to said matter through said vessel;

means for supplying a heat treatment fluid comprising a mixture of condensible and non-condensible gases and controlling the enthalpy, partial pressures and dew point;

said mixture comprising steam and non-condensible gases and said means for controlling said enthalpy includes means for varying the energy input of said condensible and non-condensible gases;

said mixture supply means comprising a vapor generator of the type wherein burning of fuel and oxidant is effected, said vapor generator including means for controlling the relative proportions of steam and non-condensibles issuing therefrom;

said means for controlling said enthalpy including means associated with said vapor generator for varying the burning rate thereof;

said means for controlling said partial pressure and dew point of said mixture including means for controlling the pressure within said vessel; and means associated with said vessel directing the flow of said treatment fluid through said vessel in a counter-current flow configuration relative to said particulate matter passing therethrough, and means defining at least two zones of fluid treatment including a first zone of moisture absorption by said particulate matter and a second zone of moisture evaporation from said particulate matter.

31. The system as set forth in claim 30 wherein said mixture comprises steam and non-condensibles directed in concurrent flow with said matter.

32. The system as set forth in claim 31 wherein said means for supplying said steam and non-condensible mixture comprises a vapor generator, said vapor generator including means for controlling the relative proportions of steam and non-condensibles issuing therefrom.

33. The system as set forth in claim 30 wherein said means for imparting movement to said matter to be heated comprises a vibrator member having a plurality of apertures formed therein for the passage of said gas mixture therethrough and the conveyance of said particulate matter therealong within said vessel and through said first and second zones defined therein for select moisture absorption and desiccation.

34. The system as set forth in claim 30 wherein said mixture of condensible and non-condendsible gases is supplied to said vessel at a temperature on the order of 400° F. and wherein said final temperature of said particulate matter is on the order of 200° F.

35. The system as set forth in claim 34 wherein said temperature of said gas mixture entering said second zone is on the order of 400° F. and said gas mixture issuing into said first zone of said vessel is on the order of 200° F.

36. The system as set forth in claim 35 wherein said gas mixture issuing into said first zone of said vessel comprises said gas mixture exhausted from said second zone of said vessel.

37. The system as set forth in claim 36 wherein said means for controlling the partial pressure of said gas mixture issuing into said first zone includes means for introducing non-condensible gases to said gas mixture exhausting from said second zone prior to being introduced into said first region.

38. The system as set forth in claim 30 wherein said means for controlling the partial pressure and dew point of said gas mixture includes means for controlling said pressure within and said gas mixture therein.

39. The system as set forth in claim 30 wherein said particulate matter comprises organic material whose chemical composition is responsive to heat and moisture and wherein means are provided for selectively controlling the duration of exposure of said matter to said gas mixture and select partial pressures thereof within said vessel for select conditioning of said matter.

40. The system as set forth in claim 39 wherein said organic material comprises grain and said system is adapted for heat and moisture conditioning of said grain for improving the digestibility and nutritive value thereof.

41. A method of heating and conditioning matter flowing through a vessel to effect select temperature and moisture conditions therein comprising the steps of:

providing a housing for passage of said matter therethrough, said housing including means for controlling the pressure therein;

providing vapor generator;

issuing a mixture of condensible and non-condensible gases from said vapor generator at a select enthalpy, partial pressures and dew point;

controlling the relative proportions of steam and non-condensibles issuing from said vapor generator to control said partial pressures;

introducing said gas mixture to a first end of said housing;

introducing said matter into a second opposite end of said housing;

imparting counter-current flow to said matter and said mixture passing through said housing for the interaction therebetween; and controlling said interaction between said mixtures and said matter within said housing and said partial pressure within said gas mixture.

42. The method as set forth in claim 41 and further including the steps of defining a first region in said housing of moisture absorption by said matter and a second region in said housing of moisture desiccation by said matter whereby the temperature and moisture content of said matter may be controlled in each of said regions.

43. The method as set forth in claim 42 and further including the steps of collecting said gas mixture from said second region of said housing and discharging said collected gas mixture into said first region for treatment of said matter therein and prior to its entry into said second region, whereby moisture may be absorbed by said matter in said first region and evaporated from said matter in said second region.

44. The method as set forth in claim 41 and including the step of heating said mixture of condensible and non-condensible gases supplied to said housing to a temperature on the order of 400° F. and producing said matter with a final temperature on the order of 200° F. and said step of discharging said vapor generator includes the step of varying the rate of burning of said vapor generator to vary said enthalpy of said mixture.

45. The method as set forth in claim 44 and including the steps of defining a first region within said housing for moisture absorption by said matter and a second region in said housing for moisture desiccation from said matter and wherein said temperature of said gas mixture entering said second region is on the order of 400° F. and said gas mixture issuing into said first region of said vessel is on the order of 200° F.

46. The method as set forth in claim 45 including the steps of collecting said gas mixture from said second region and diverting it into said first region of said housing while controlling the partial pressure thereof.

47. The method as set forth in claim 43 wherein said steps of controlling the partial pressure of said gas mixture issuing into said first region includes the step of introducing non-condensible gases to said gas mixture exhausting from said second region prior to being introduced into said first region.

48. The method as set forth in claim 41 wherein said step of controlling the partial pressure of said gas mixture includes the step of introducing non-condensible gases to said gas mixture prior to being introduced to said matter.

49. The method as set forth in claim 41 wherein said matter comprises organic material whose chemical composition is responsive to heat and moisture and the method further includes the step of selectively controlling the duration of exposure of said matter to said gas mixture within said housing for select conditioning of said chemical compositon.

50. A method of producing matter having a select temperature comprising the steps of:

providing a vessel for the introduction of said matter therein;

providing a mixture of condensible and non condensible gases at a select enthalpy, partial pressure and dew point;

discharging said gas mixture into said vessel for engaging said matter therein;

establishing an interaction region between said matter and said gas mixture within said vessel;

supplying said gas mixture to said interaction region at said select enthalpy, partial pressure and dew point;

controlling said dew point of said gas mixture for controlling the temperature of said matter engaged by said gas mixture;

interacting said matter and said gas mixture within said vessel to effect a select temperature within said matter;

exhausting said gas mixture from said vessel after engagement with said matter; and collecting said conditioned matter after engagement with said gas mixture within said vessel.

51. The method as set forth in claim 50 and further including the steps of controlling the liquid constituent level in said matter by defining a first region in said vessel of moisture absorption by said matter and a second region in said vessel of moisture desiccation by said matter whereby the temperature and moisture content of said matter may be controlled in each of said regions.

52. The method as set forth in claim 51 and further including the steps of collecting said gas mixture from said second region of said vessel and discharging said collected gas mixture into said first region for treatment of said matter therein and prior to its entry into said second region, whereby moisture may be absorbed by said matter in said first region and evaporated from said matter in said second region.

53. The method as set forth in claim 50 wherein said mixture comprises steam and non-condensible gases.

54. The method as set forth in claim 53 wherein said steps of providing said mixture comprises the step of providing a vapor generator, discharging said vapor generator into said vessel, and controlling the relative proportions of steam and non-condensible gases issuing from said vapor generator to control said partial pressures.

55. The method as set forth in claim 50 and including the step of heating said mixture of condensible and non condendsible gases supplied to said vessel to a temperature on the order of 400° F. and producing said matter with a final temperature on the order of 200° F.

56. The method as set forth in claim 55 and including the steps of defining a first region within said vessel for moisture absorption by said matter and a second region in said vessel for moisture desiccation from said matter and wherein said temperature of said gas mixture entering said second region is on the order of 400° F. and said gas mixture issuing into said first region of said vessel is on the order of 200° F.

57. The method as set forth in claim 55 including the steps of collecting said gas mixture from said second region and diverting it into said first region of said housing while controlling the partial pressure thereof.

58. The method as set forth in claim 52 wherein said steps of controlling the partial pressure of said gas mixture issuing into said first region includes the step of introducing non-condensible gases to said gas mixture exhausting from said second region prior to being introduced into said first region.

59. The method as set forth in claim 50 wherein said step of controlling said dew point of said gas mixture includes the step of controlling the pressure within said vessel and controlling the partial pressure of said gas mixture.

60. The method as set forth in claim 50 wherein said matter comprises organic material whose chemical composition is responsive to heat and moisture and the method further includes the step of selectively controlling the duration of exposure of said matter to said gas mixture within said vessel for select conditioning of said chemical composition.

61. An improved system for the heat conditioning of matter of the type wherein a housing is provided for the exposure of matter therein to the flow of condensible gas therearound for heating said matter, wherein the improvement comprises means for providing a mixture of condensible and non-condensible gases to said housing, said means for supplying said steam and non-condensible mixture comprising a vapor generator of the type wherein burning of fuel and oxidant is effected, said vapor generator including means for controlling the relative proportions of steam and non-condensibles issuing therefrom for control of said partial pressures within said housing; means for imparting the flow of said gas mixture through said housing relative to said matter passing therethrough; means for controlling the enthalpy, partial pressure and dew point of said gas mixture to define the final temperature of said matter; means for controlling the partial pressures of said gas mixture to control the liquid constituent level of said matter and the temperature thereof, said means for controlling said enthalpy including means associated with said vapor generator for varying the burning rate thereof, and said means for controlling the partial pressure and dew point of said gas mixture including means for controlling the pressure within said housing and said gas mixture therein.

62. The system as set forth in claim 61 and including a first region in said housing for liquid constituent absorption by said matter and a second region for liquid constituent desiccation by said matter and wherein said gas mixture is introduced into said second region for liquid constituent desiccation of said matter as it issues from said first region, said gas mixture further being collected from said second region for introduction into said first region for treatment of said matter therein, prior to its entry into said second region, whereby moisture may be absorbed by said matter in said first region and evaporated from said matter in said second region.

63. The system as set forth in claim 61 wherein means are provided for defining a first region within said housing for moisture absorption by said matter and a second region in said housing for moisture desiccation from said matter and wherein said temperature of said gas mixture entering the said second region is on the order of 400° F. and said gas mixture issuing into said first region of said vessel is on the order of 200° F.

64. The system as set forth in claim 63 wherein said gas mixture issuing into said first region of said vessel comprises said gas mixture exhausted from said second region of said vessel.

65. The system as set forth in claim 62 wherein said means for controlling the partial pressure of said gas mixture issuing into said first region includes means for introducing non-condensible gases to said gas mixture exhausting from said second region prior to being introduced into said first region.

66. The system as set forth in claim 61 wherein said matter comprises organic material whose chemical composition is respsonsive to heat and moisture and wherein means are provided for selectively controlling the duration of exposure of said matter to said gas mixture and select partial pressures thereof within said vessel for select conditioning of said matter.

67. The system as set forth in claim 66 wherein said organic material comprises grain and said system is adapted for heat and moisture conditioning of said grain for improving the digestibility and nutritive value thereof.

68. An improved system for temperature and moisture conditioning of matter of the type wherein matter to be conditioned is exposed to a vapor within a vessel for select heat and moisture absorption and/or desiccation, wherein the improvement comprises means for supplying a mixture of condensible and non-condensible gases and controlling enthalpy, partial pressure and dew point thereof;

means for delivering said gas mixture;

means for interaction between said gas mixture and said matter thereby controlling the temperature of said matter to approximate the dew point of said mixture; and means for controlling the partial pressure of said condensible gas so as to control the moisture condensed on said matter.

69. The system as set forth in claim 68 and further including means for controlling the partial pressures of said gas mixture and defining a first region of moisture absorption by said matter and a second region of moisture desiccation by said matter whereby the temperature and moisture content of said matter may be controlled.

70. The system as set forth in claim 69 wherein said gas mixture is introduced into said second region for moisture desiccation of said matter as it issues from said first region, said gas mixture further being collected from said second region for introduction into said first region for treatment of said matter therein, prior to its entry into said second region, whereby moisture may be absorbed by said matter in said first region and evaporated from said matter in said second region.

71. The system as set forth in claim 68 wherein said mixture comprises steam and non-condensible gases and said means for controlling said enthalpy includes means for varying the energy input to said steam and non-condensible gases.

72. The system as set forth in claim 68 wherein said mixture comprises steam and non-condensible gases and said mixture supply means comprises a vapor generator of the type wherein burning of fuel and oxidant is effected, said vapor generator including means for controlling the relative proportions of steam and non-condensibles issuing therefrom.

73. The system as set forth in claim 72 wherein said vessel comprises a housing having means disposed therein for defining a first and a second region therein for exposing said matter in said first and second regions to said gas mixture at different partial pressures.

74. The system as set forth in claim 72 or 73 wherein said means for controlling said enthalpy includes means associated with said vapor generator for varying the burning rate thereof.

75. The system as set forth in claim 68 wherein said means for controlling said partial pressure and dew point of said mixture includes means for controlling the pressure within said vessel to control the partial pressure of said mixture contained therein.

76. The system as set forth in claim 68 wherein said mixture of condensible and non-condendsible gases is supplied to said vessel at a temperature on the order of 400° F. and wherein said final temperature of said matter is on the order of 200° F.

77. The system as set forth in claim 76 wherein means are provided for defining a first region within said vessel for moisture absorption by said matter and a second region in said vessel for moisture desiccation from said matter and wherein said temperature of said gas mixture entering the said second region is on the order of 400° F. and said gas mixture issuing into said first region of said vessel is on the order of 200° F.

78. The system as set forth in claim 77 wherein said gas mixture issuing into said first region of said vessel comprises said gas mixture exhausted from said second region of said vessel.

79. The system as set forth in claim 70 wherein said means for controlling the partial pressure of said gas mixture issuing into said first region includes means for introducing non-condensible gases to said gas mixture exhausting from said second region prior to being introduced into said first region.

80. The system as set forth in claim 68 wherein said means for controlling the partial pressure of said gas mixture includes means for introducing non-condensible gases to said gas mixture prior to being introduced to said matter.

81. The system as set forth in claim 68 wherein said matter comprises organic material whose chemical composition is responsive to heat and moisture and wherein means are provided for selectively controlling the duration of exposure of said matter to said gas mixture and select partial pressures thereof within said vessel for select conditioning of said matter.

82. The system as set forth in claim 81 wherein said organic material comprises grain and said system is adapted for heat and moisture conditioning of said grain for improving the digestibility and nutritive value thereof.

* * * * *